US008627703B2

(12) United States Patent
Corder

(10) Patent No.: US 8,627,703 B2
(45) Date of Patent: Jan. 14, 2014

(54) LINEAR DRAWING MACHINE AND METHOD FOR LINEAR DRAWING OF A WORKPIECE THROUGH A DRAWING RING

(75) Inventor: Anthony James Corder, Bishop Auckland (GB)

(73) Assignee: SMS Meer GmbH, Moenchengladbach (DE)

( * ) Notice: Subject to any disclaimer, the term of this patent is extended or adjusted under 35 U.S.C. 154(b) by 836 days.

(21) Appl. No.: 12/584,748

(22) Filed: Sep. 11, 2009

(65) Prior Publication Data

US 2010/0064750 A1 Mar. 18, 2010

(30) Foreign Application Priority Data

Sep. 14, 2008 (DE) ..... 10 2008 047 260

(51) Int. Cl.
*B21C 37/30* (2006.01)

(52) U.S. Cl.
USPC ..... 72/370.25; 72/277

(58) Field of Classification Search
USPC ..... 72/370.01, 370.25, 274, 285, 287, 289, 72/291, 290, 343, 277
See application file for complete search history.

(56) References Cited

U.S. PATENT DOCUMENTS

| | | | | |
|---|---|---|---|---|
| 3,095,083 | A | 6/1963 | Helble et al. | |
| 3,131,803 | A | 5/1964 | Hill et al. | |
| 3,167,176 | A | 1/1965 | Hill et al | |
| 3,654,794 | A * | 4/1972 | Brak et al. | 72/285 |
| 5,060,500 | A * | 10/1991 | Ohneda et al. | 72/287 |
| 5,771,727 | A * | 6/1998 | Stinnertz et al. | 72/21.4 |
| 5,907,969 | A * | 6/1999 | Soder | 72/370.01 |

FOREIGN PATENT DOCUMENTS

| | | |
|---|---|---|
| DE | 1 959 676 | 6/1971 |
| DE | 196 10 642 | 9/1997 |
| EP | 1 022 070 | 7/2000 |
| GB | 2 158 755 | 11/1985 |

OTHER PUBLICATIONS

Benson, Von N. D., "Praktische und theoretische Gesichtspunkte bei der Gestaltung fliegender Ziehdorne [Practical and Theoretical Aspects in the Design of Flying Drawing Mandrels]" in The Magazine for Metallurgy, vol. 57, Issue 10, Oct. 1966, pp. 717-724. (Spec, p. 2).

Submission of third party concerning the parallel German patent procedure dated Jan. 17, 2011 in De 10 2009 039 873.2, with English translation of same.

Moik, Manfred, "Veränderung der Exzentrizität der Rohre beim Gleitziehen mittels Variation der Einlaufrichtung," 2007, pp. 1-15.

Jost, Norbert, "Beiträge der Hochschule Pforzheim," Technik-Forum 2006, Innovative neue Techniken für Werkzeuge der Kaltverformung, No. 125, Jun. 2007, pp. 1 and 89-111.

* cited by examiner

*Primary Examiner* — Shelley Self
*Assistant Examiner* — Matthew G Katcoff
(74) *Attorney, Agent, or Firm* — Collard & Roe, P.C.

(57) ABSTRACT

In order to allow a more targeted intervention in a drawing procedure, in particular on a linear drawing device, the invention proposes a linear drawing machine for the linear drawing of a workpiece through a drawing ring, a drawing unit, in which one or more drawing tools grasp the workpiece and draw it linearly in the drawing direction, being situated behind the drawing ring, the linear drawing device being distinguished in particular by a drawing ring which is situated fixed in relation to the drawing direction during the drawing procedure, preferably perpendicularly, and by a workpiece guide situated in front of the drawing ring in the drawing direction, which is displaceable perpendicular to the drawing direction.

6 Claims, 7 Drawing Sheets

LINEAR DRAWING MACHINE AND METHOD FOR LINEAR DRAWING OF A WORKPIECE THROUGH A DRAWING RING

CROSS REFERENCE TO RELATED APPLICATIONS

Applicant claims priority under 35 U.S.C. §119 of German Application No. 10 2008 047 260.3 filed on Sep. 14, 2008.

The invention relates, on the one hand, to a linear drawing machine for the linear drawing of a workpiece through a drawing ring, a drawing unit, in which one or more drawing tools grasp the workpiece and draw it linearly in the drawing direction, being situated behind the drawing ring. On the other hand, the invention relates to a method for linear drawing of a workpiece through a drawing ring, a drawing unit being situated behind the drawing ring, which grasps the workpiece using one drawing tool or using multiple drawing tools and draws it linearly in a drawing direction.

Linear drawing methods and linear drawing machines are primarily distinguished by differentiation from other drawing methods and drawing machines in that a force is applied linearly to the workpiece therein and is drawn through a drawing block and/or drawing ring, and are thus differentiated from drum drawing machines, for example, in which the traction force is applied in that the workpiece is laid around a drum, for example, in a V-shaped groove of a drum, and the drawing force is applied via a drum drive. Due to the latter measure, the workpiece deforms in its cross-section after the drawing, so that only limited requirements may be placed on the implementation of the cross-section in workpieces drawn in this way.

This is not the case in linear drawing methods and machines, in which only small changes of the cross-section caused by the drawing process are finally to be expected once the workpiece has passed the drawing ring.

Unequal distributions of the mass in the cross-section through the workpiece also result in practice after the drawing, which are caused in particular by unequal distributions already present in the undrawn workpiece. Unequal mass distributions of this type may be caused in this case, for example, by forging and/or rolling processes or local temperature differences during the production of a blank.

In particular in the drawing machining of tubular workpieces, one differentiates between fixed and floating drawing mandrels, the first being held on a rod or another very long holding device in front of the intake side at the height of the drawing ring, while the latter remains freely floating at the height of the drawing ring due to its shaping and the drawing movement, caused by an interaction between friction and displacement work. The interaction between friction and displacement work often ultimately results in axial oscillations, i.e., in oscillations along the drawing directions, which are also known in fixed drawing mandrels, however, in that the rod and/or the holding unit act as a spring at the lengths which are required, as described by Benson in his article "praktische und theoretische Gesichtpunkte bei der Gestaltung fliegender Ziehdorne [Practical and Theoretical Aspects in the Design of Flying Drawing Mandrels]" in der Zeitschrift für Metallkunde [The Magazine for Metallurgy], vol. 57, issue 10, October 1966 (1966-10) on pages 717 through 724.

While the axial oscillation is well controllable in particular in floating drawing mandrels by suitable design of a conical drawing mandrel part and a calibrating drawing mandrel part, these measures optionally also being able to be used in fixed drawing mandrels, unless they dispense with a conical drawing mandrel part entirely, there are various approaches for controlling the location of the drawing mandrel even perpendicular to the drawing direction, in order to improve the drawing result, in particular the uniformity in the cross-section of the workpiece to be drawn. If the rods or long holding units in fixed drawing mandrels are solely to be observed as long springs, it is immediately re-constructible that in this way a noticeable influence on the location of the drawing mandrel cannot also be performed perpendicular to the drawing direction, so that measures must also be used therein, precisely as with floating drawing mandrels, which engage in spatial proximity to the drawing ring. In this regard, a differentiation does not have to be made between fixed and floating drawing mandrels.

Thus, DE 196 10 642 A1 discloses a method and a device for the cold drawing of seamless tubes, in which the eccentricity and the inclination of the drawing mandrel relative to a drawing axis, an axis oriented parallel to the drawing direction and running centrally through the drawing ring, may be manipulated using a guide situated in the drawing direction behind the drawing ring and acting externally on the workpiece, in that the calibrating drawing mandrel part, which substantially defines the inclination of a drawing mandrel in any case, is lengthened up to the guide.

A manipulation possibility which is somewhat different, but nonetheless acts through a measure behind the drawing ring in the drawing direction, is disclosed in U.S. Pat. No. 3,167,176, in which the drawing mandrel, which exclusively comprises a calibrating part and is implemented fixed in this achievement of the object, is mounted behind the drawing ring so it is pivotable around a pivot point.

In addition, DE 196 10 642 A1 also discloses a displacement of the drawing ring, in order to be able to act correspondingly on the drawing result, U.S. Pat. No. 3,131,803 and DE 19 59 676 A also proposing an inclination change of the drawing ring.

EP 1 022 070 A2 also discloses a displaceable drawing ring and a mandrel guided opposite to the drawing direction, which can also be changed in regard to its inclination angle relative to the drawing axle by a force which can be applied on a mandrel guide located on the drawing mandrel opposite to the drawing direction. As is immediately obvious, in this design, the spacing between mandrel guide and drawing mandrel is selected as sufficiently small that a tilting torque can be transmitted effectively from the mandrel guide onto the mandrel, which is not possible with long rods or other long holding units, as are used in fixed drawing mandrels.

All of these measures substantially change the cross-section of the workpiece after the drawing and/or the mass distribution in the cross-section of the workpiece after the drawing and also in a predictable way. However, it has been shown that a uniform mass distribution can hardly be achieved using these measures, because complex changes in the mass distribution are caused by the inclination change of the drawing ring and/or the drawing mandrel, which possibly display the desired effects at one point, but necessarily cause a corresponding disadvantageous effect at another point. This is also true for eccentric displacements of the drawing ring or the drawing mandrel, for example, according to DE 196 10 642 A1, which also result in complex changes in the mass distribution of this type.

It is correspondingly the object of the present invention to provide a linear drawing machine according to the species and a linear drawing method according to the species, which allow a more targeted engagement in the drawing procedure and thus a more targeted influence of the drawing result.

A linear drawing machine and/or a linear drawing method according to the independent claims are proposed as the achievement of the object. Further advantageous designs are found in the subclaims.

The linear drawing machine has a drawing ring for this purpose, a drawing unit being situated behind the drawing ring in which one or more drawing tools grasp the workpiece and draw it linearly in the drawing direction. The linear drawing machine is advantageously distinguished by a drawing ring which is situated fixed, preferably perpendicularly, during the drawing procedure relative to the drawing direction and by a workpiece guide situated in front of the drawing ring in the drawing direction, which is displaceable perpendicularly to the drawing direction.

The drawing ring situated perpendicular relative to the drawing direction advantageously causes the drawn workpiece to be optimally centered, and thus to leave the drawing ring with an optimum uniform mass distribution.

On the other hand, it is possible through an eccentric feed to compensate for an unequal mass distribution in the workpiece still to be drawn, it being assumed according to the invention that through the eccentric feed at one point, excessive material provided correspondingly becomes excessively free-flowing and can thus be displaced to other areas of the workpiece. Correspondingly, it appears advantageous to eccentrically orient the workpiece where material is present in excess in the cross-section.

An eccentric orientation in this regard of the workpiece to be drawn is advantageously successful with particular operational reliability using the workpiece guide situated in front of the drawing ring so it is displaceable perpendicular to the drawing direction.

The object of the invention is also achieved by a method for the linear drawing of a workpiece through a drawing ring, a drawing unit being situated behind the drawing ring, which grasps the workpiece using a drawing tool or using multiple drawing tools and draws it linearly in a drawing direction, and the drawing ring being oriented perpendicular to the drawing direction during the drawing procedure, and the workpiece further being inserted into the drawing ring using a workpiece guide which is situated in front of the drawing ring in the drawing direction and is displaceable perpendicular to the drawing direction.

According to the invention, using a method guide selected in this way, a workpiece to be drawn can particularly advantageously be oriented eccentrically in front of the drawing ring, in order to influence the drawing result.

A uniform workpiece cross-section can be ensured after the drawing, especially for a tubular workpiece, in particular by a drawing mandrel which is freely mounted perpendicular to the drawing direction opposite to the drawing direction. The drawing mandrel is capable of optimally orienting itself appropriately freely and/or solely through forces acting thereon in the drawing procedure or behind the drawing ring. In this way, the most uniform possible cross-section is ensured upon leaving the drawing ring and/or the drawing mandrel, the drawing mandrel preferably being oriented parallel to the drawing direction and/or the drawing axis and centrally to the drawing axis, so that the workpiece leaving the drawing ring and the drawing mandrel images their shape as precisely as possible. Material irregularities may in turn be deliberately equalized by the deviation of the workpiece guide from the drawing axis.

Notwithstanding EP 1 022 070 A2, in the configuration and/or procedure proposed above, a displacement of the workpiece guide does not directly cause tilting and/or an inclination change of the drawing mandrel, which significantly improves the drawing result according to the invention.

The required displacement of the workpiece guide can be ascertained and performed extraordinarily precisely if the mass distribution in the cross-section of the workpiece is measured and the workpiece guide is displaced in accordance with the measured mass distribution.

For such measuring of the mass distribution, it is particularly advantageous in regard to the device if a measuring unit is situated in the area of the drawing ring or in the drawing ring, using which the mass distribution of the workpiece material can be measured in the area of the drawing ring or in the drawing ring. Using a measuring unit of this type, a corresponding control command for displacing the workpiece guide can be generated in a particularly cost-effective way. At drawing velocities which are not excessively high, a displacement of this type can also be performed sufficiently rapidly that the workpiece guide can always be set optimally.

A preferred method variant thus also provides that the mass distribution is measured in the cross-section of the workpiece and the workpiece guide is displaced suitably corresponding to the measured mass distribution.

In addition, an advantageous embodiment variant provides that a measuring unit is situated in front of the drawing ring in the drawing direction, using which the mass distribution of the workpiece material can be measured in the drawing ring. In particular with this construction, a corresponding control command can be ascertained especially rapidly and relayed to the workpiece guide.

The present measuring unit can be implemented in manifold constructions. In a preferred construction embodiment, the measuring unit can comprise suitable ultrasonic sensors, using which a mass distribution on the workpiece to be drawn can be measured very exactly.

Because the present measuring unit and the present measuring method also advantageously refine workpiece drawing methods according to the species, the features in this regard are also advantageous without the remaining features of the invention in connection with linear drawing machines and corresponding methods.

Furthermore, the workpiece can be guided more precisely and especially relieved in its deformation area, i.e., where the drawing ring and optionally the drawing mandrel act, if the workpiece guide has a guide section which is longer than the diameter of the workpiece.

If the workpiece guide has a guide section which is directed toward the drawing ring, the workpiece can be guided even more precisely and additionally relieved in the deformation area.

The guide of the workpiece can be cumulatively or alternatively improved further if the workpiece guide has a guide section and at least two guide points provided along the guide section. The workpiece can thus also be relieved further especially in the deformation area.

Furthermore, a preferred embodiment variant provides that the workpiece guide has means for displacement which comprise a pivot guide around a pivot point, preferably around a pivot point situated on the drawing axis in the area of the drawing block. A particularly careful displacement of the workpiece guide is thus made possible in particular without the danger arising that the workpiece will be excessively strained in the plastically deformed area.

A suitable and advantageous implementation can be performed, for example, by a gimbal mounting around the drawing ring or by suitable guide rails. However, a different or more complex determination of the displacement capabilities of the workpiece guide can also be ensured via suitably designed guide rails.

In any case, it is advantageous if the workpiece guide is displaced around a suitable pivot point.

For this purpose, an advantageous method variant provides that the pivot point is situated on the drawing axis, preferably at the height of the drawing ring. The preceding particularly careful displacement can thus be achieved according to the method without the workpiece being excessively strained in the plastically deformed area.

In order to keep friction losses during the guiding of the workpiece in front of the drawing ring as low as possible in particular, it is advantageous if the workpiece guide comprises a roller guide of the workpiece. As is explained in greater detail in regard to the following exemplary embodiments, the roller guide can advantageously be equipped for this purpose with suitable roll and/or roller pairs.

Further advantages, goals, and properties of the present invention are explained on the basis of the following description of the appended drawings, in which relevant drawing components of linear drawing machines for linear drawing of a workpiece are shown as examples, which comprise at least one drawing ring and a workpiece guide displaceable perpendicularly to the drawing direction of the workpiece.

Figure 1:
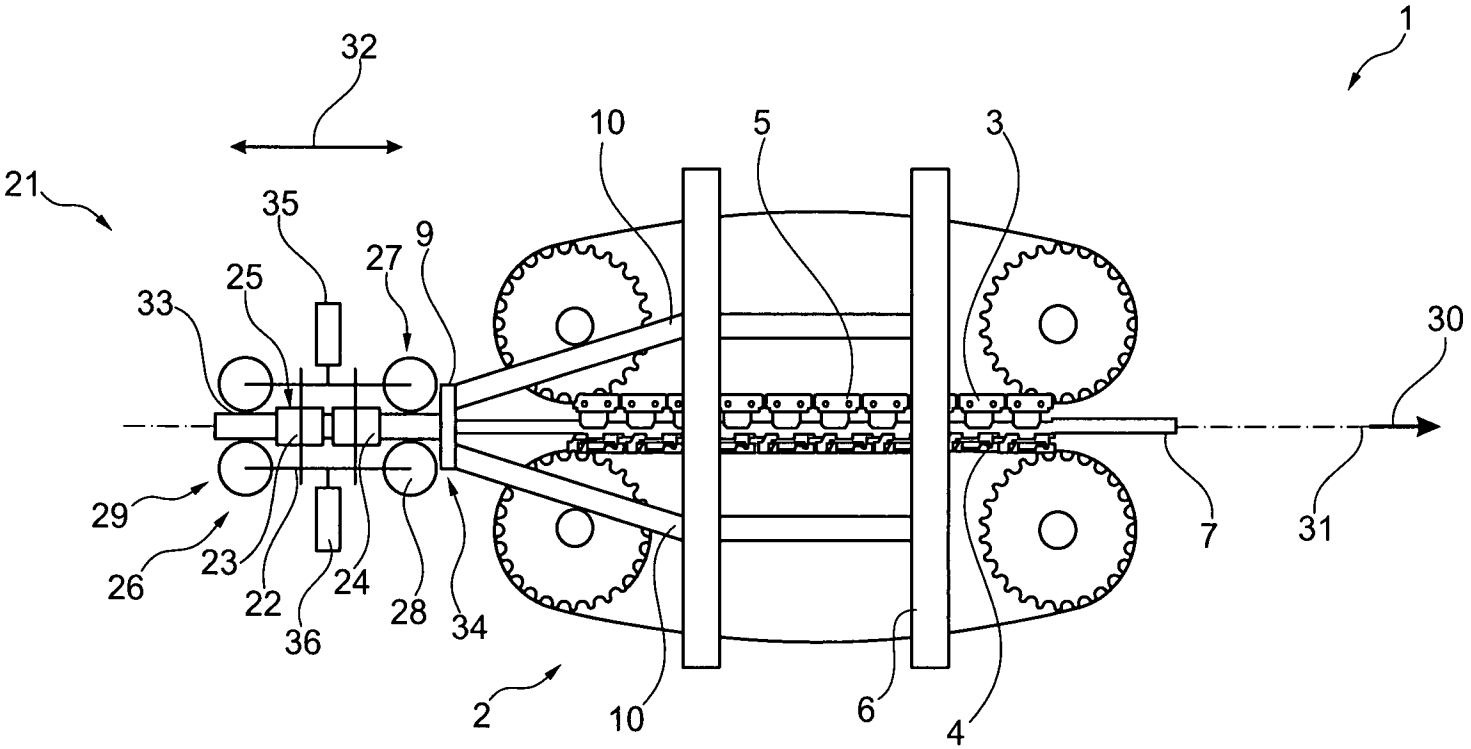
FIG. 1 shows a linear drawing machine having a displaceable workpiece guide and having a unit for measuring a mass distribution of a workpiece material in a schematic side view.
Figure 2:
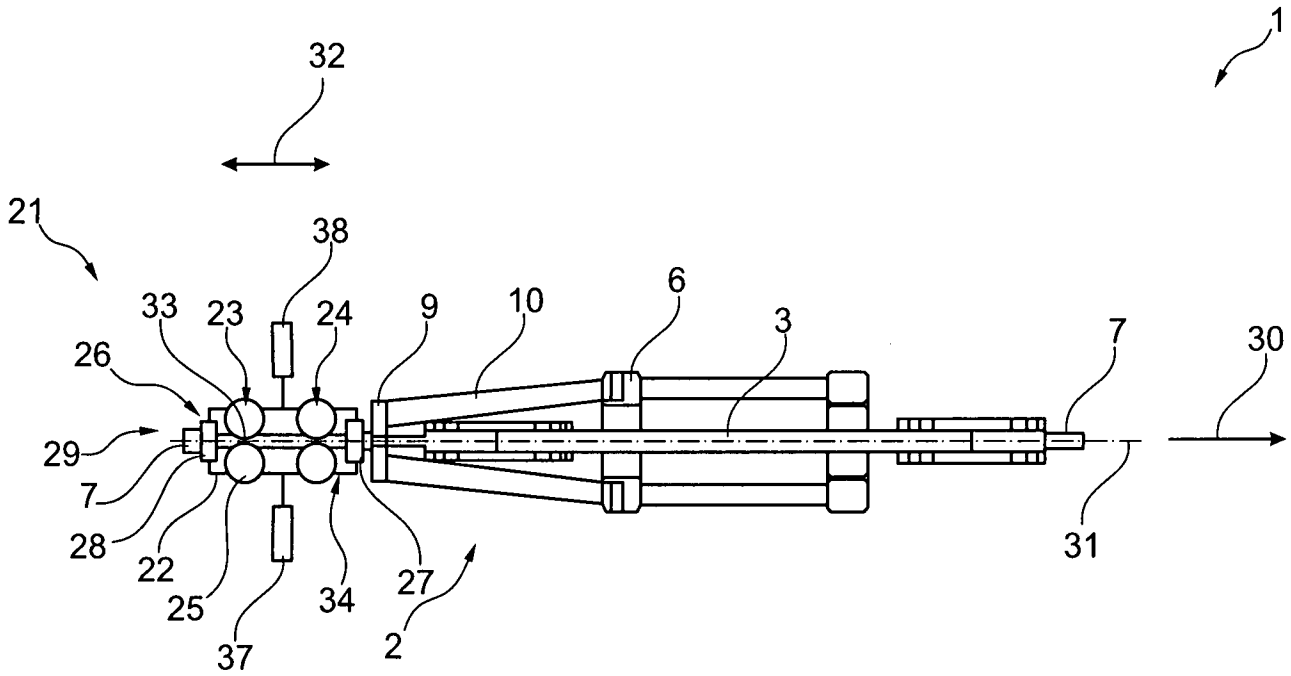
FIG. 2 shows the linear drawing machine from FIG. 1 in a schematic top view.
Figure 3:
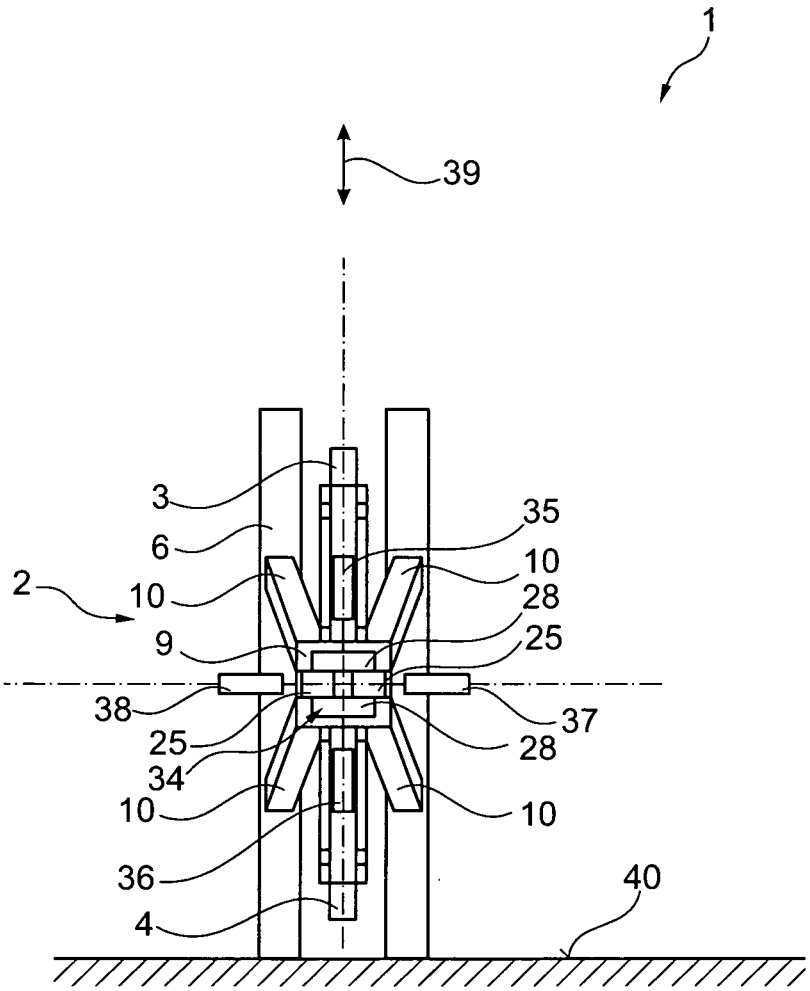
FIG. 3 shows the linear drawing machine from FIGS. 1 and 2 in a schematic frontal view.
Figure 4:
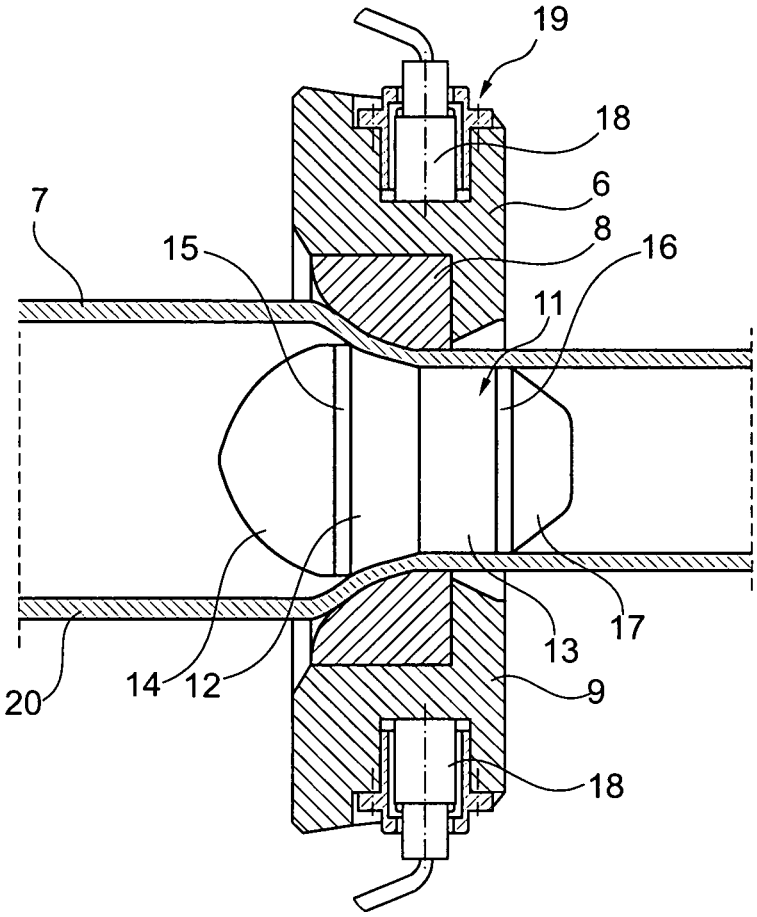
Figure 5:
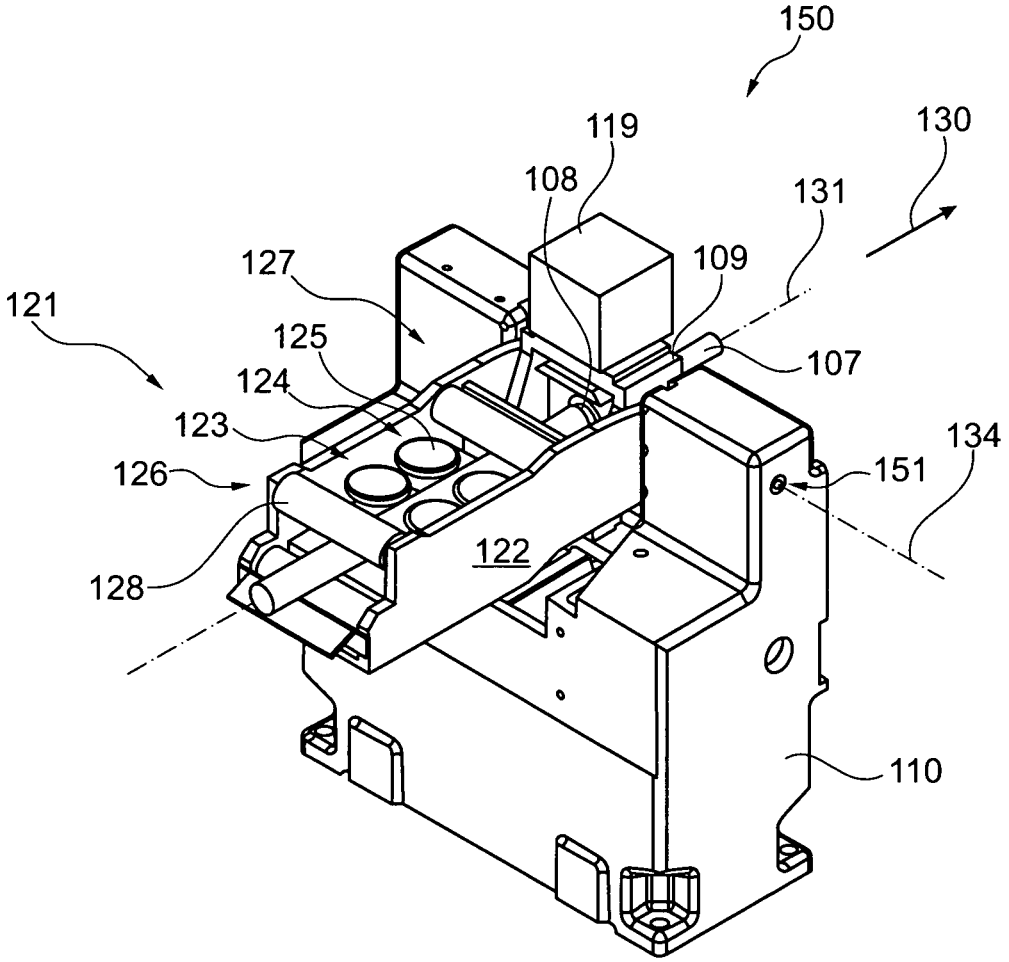
Figure 6:
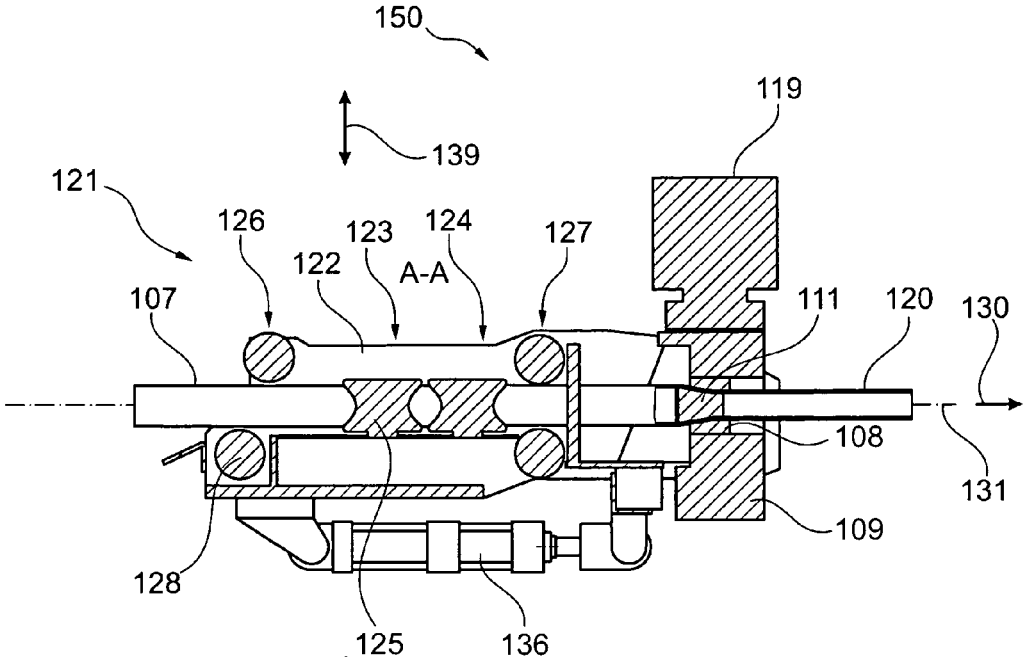
Figure 7:
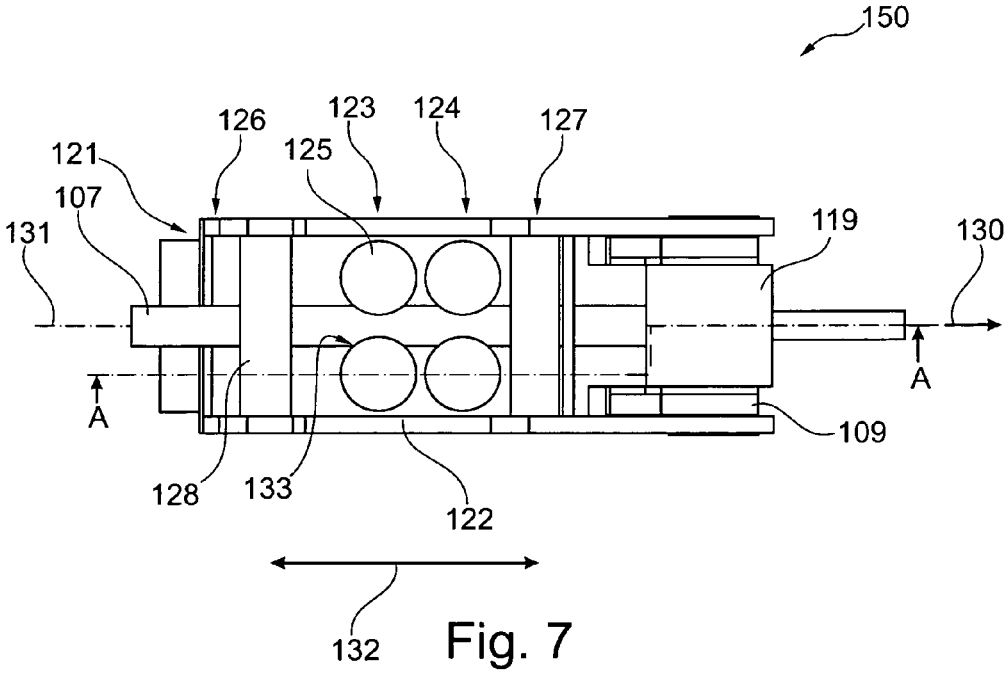
Figure 8:
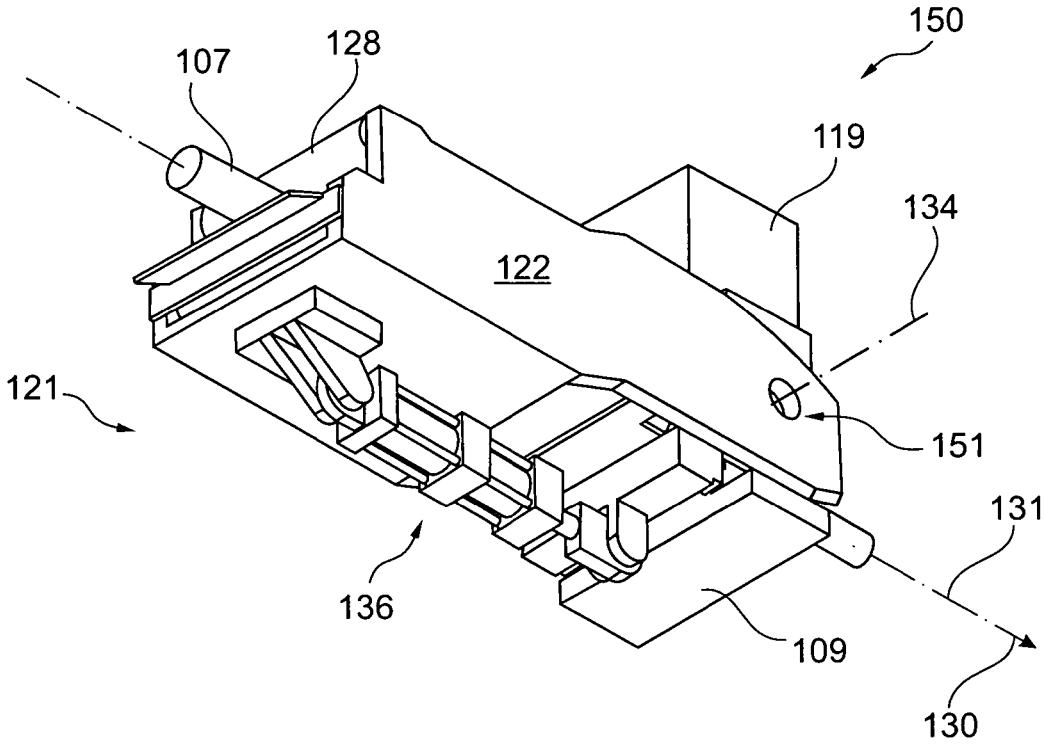
Figure 9:
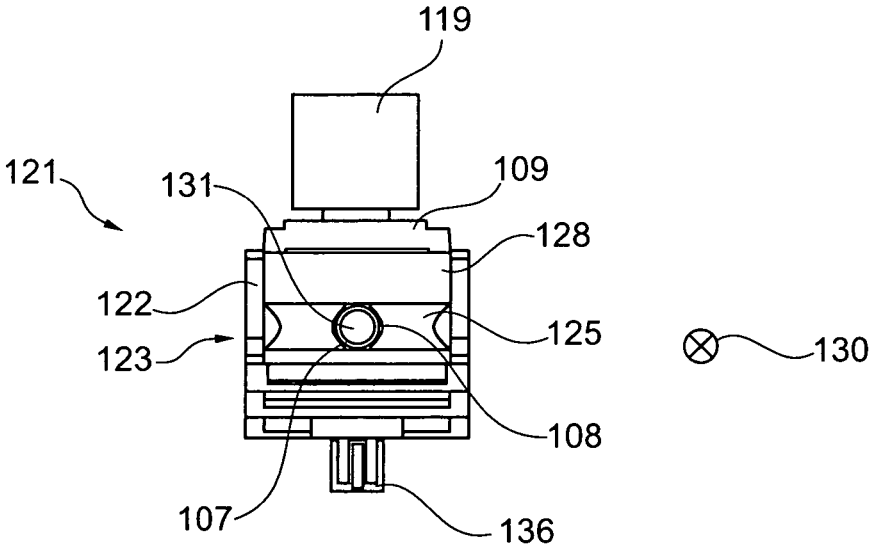

FIG. 4 schematically shows a section in particular through a drawing ring of the linear drawing machine from FIGS. 1 through 3 with drawn-through tube;

FIG. 5 schematically shows an alternatively designed drawing head on a mount carrier of a linear drawing machine (not shown in greater detail here) having a workpiece guide displaceable perpendicularly to a drawing direction and having a unit for measuring a mass distribution of a workpiece material in a perspective view;

FIG. 6 shows the drawing head according to FIG. 5 in a schematic sectional view along section line A-A according to the illustration from FIG. 7;

FIG. 7 shows the drawing head from FIGS. 5 and 6 in a schematic top view;

FIG. 8 once again schematically shows the drawing head from FIGS. 5 through 7 in a further perspective view; and FIG. 9 shows a schematic view of the drawing head from FIGS. 5 through 8 in a view opposite to the drawing direction.

The linear drawing machine 1 shown in FIGS. 1 through 4 comprises a drawing unit 2, which is implemented in this first exemplary embodiment excerpt shown as a caterpillar-type drawing die. The drawing unit 2 and/or the caterpillar-type drawing die in this regard comprises two revolving drawing chains 3 and 4 (only indicated schematically) in a way known per se, which are equipped with drawing tools 5 (only numbered as examples) and are mounted in a way known per se on a rack 6, an elongate workpiece 7 being able to be drawn through a drawing ring 8 (see FIG. 4), which is mounted on the rack 6, via the drawing tools 5.

For this purpose, the drawing ring 8 is mounted in a plate-like drawing ring mount 9, which relays the traction forces acting thereon into the remaining rack 6 via mount carriers 10.

It is obvious that without deviating from the basic idea of the present invention, instead of a caterpillar-type drawing die shown as an example here as the drawing unit 2, any other linearly acting drawing unit, for example, a drawing slide, whether it is active continuously alternating with one or more further drawing slides or is only active once in a continuous, very long drawing procedure, can be used.

A drawing mandrel 11, which interacts during the drawing with the drawing ring 8 via the workpiece 7, is located inside the workpiece 7 for drawing the workpiece 7. The drawing mandrel 11 is divided into a conical drawing mandrel part 12 and a calibrating drawing mandrel part 13, the conical drawing mandrel part 12 forming a drawing mandrel inlet 14 of the drawing mandrel 11. A first transition phase 15 is provided in the transition between the drawing mandrel intake 14 and the conical drawing mandrel part 12. A further transition phase 16 exists between the calibrating drawing mandrel part 13 and a drawing mandrel outlet 16 of the drawing mandrel 11.

Furthermore, ultrasonic sensors 18 (see FIG. 4) are situated on the plate-like drawing ring mount 9, using which the mass distribution of the workpiece 7 can be measured in the area of the drawing ring 8 in particular. A measuring unit 19 having a particularly simple construction can advantageously already be provided for measuring the mass distribution of a workpiece material 20 of the workpiece 7 to be drawn solely using such ultrasonic sensors 18.

A particularly operationally-reliable workpiece guide 21 can be provided using a framework 22, on which two roll pairs 23 and 24 having corresponding rolls 25 situated opposite in pairs (only numbered as examples here) and two roller pairs 26 and 27 having corresponding rollers 28 situated opposite in pairs (also only numbered as examples here) are situated. The workpiece guide 21 thus has a roller guide 29 correspondingly well-equipped with rolls 25 and rollers 28. In this way, the very soft area of the workpiece 7 in the area of the drawing ring 8 is relieved, so that an optimum drawing result can always be implemented.

The workpiece guide 21 forms a guide section 32 using its rolls 25 and rollers 28 situated in the drawing direction 30 and along a corresponding drawing axis 31, which is longer than the diameter of the workpiece 7. In addition, the guide section 32 is oriented toward the drawing ring 8 viewed in the drawing direction. The rolls 25 and the rollers 28 form corresponding guide points 33 (only numbered as examples here) on the guide section 32. In particular these additional measures promote the guiding of the workpiece 7 in front of the drawing ring 8.

In this exemplary embodiment, the framework 22 is guided via a gimbal configuration (not shown) oriented relative to a pivot point 34, the pivot point 34 being situated on the drawing axis 31 in the area of the drawing ring 8. The movement of the framework 22 is controlled by hydraulic cylinders 35 through 38, the hydraulic cylinder 35 being placed above and the hydraulic cylinder 36 being placed below the framework 22. Correspondingly, the first lateral hydraulic cylinder 37 is situated on the right and the second lateral hydraulic cylinder 38 is situated on the left of the framework 22.

In particular using the hydraulic cylinders 35, 36, 37, and 38, in this exemplary embodiment, the entire workpiece guide 21 situated in front of the drawing ring 8 is displaceable perpendicular 39 to the drawing direction 30 and/or the drawing axis 31, so that the workpiece 7 to be drawn can advantageously be supplied to the drawing ring 8 oriented appropriately depending on the existing and/or resulting mass distribution of the workpiece material 20, whereby the tube quality is improved substantially in particular on the drawn workpiece 7. Optionally, only single rollers and/or rolls may also be displaced correspondingly, whereby a supply axis, along which the workpiece 7 is supplied to the drawing ring 8, can also be oriented in front of the drawing ring 8 deviating from the drawing axis 31 behind the drawing ring 8.

The entire linear drawing machine 1 is mounted using its rack 6 on a floor 40 and is correspondingly torsionally stiff and well anchored there.

An alternatively designed drawing head 150 of a further linear drawing machine (not shown in greater detail) is shown in FIGS. 5 through 9. The drawing head 150 is seated on a mount carrier 110, which is connected fixed to a rack (not shown) of the further linear drawing machine.

The drawing head 150 has a drawing ring 108 (see FIG. 6 in particular), which is held by a drawing ring mount 109. A workpiece 107 is drawn through the drawing ring 108, this workpiece moving along a drawing axis 131 in the drawing direction 130 for this purpose. A drawing mandrel 111, which interacts with the drawing ring 108 via the workpiece 107, is located in the area of the drawing ring 108 inside the workpiece 107. The drawing mandrel 111 is also freely mounted perpendicular to the drawing direction 130 opposite to the drawing direction 130.

A measuring unit 119 is placed on top of the drawing ring 108, using which a mass distribution of the workpiece material 120 of the workpiece 107 to be drawn can be measured. The tube quality of the workpiece 107 can thus be monitored very well, influence being able to be taken immediately on the execution of the drawing process in regard to a critical mass distribution.

For this purpose, for example, a workpiece guide 121 situated in front of the drawing ring 108 can be displaced perpendicularly to the drawing axis 131 and/or to the drawing direction 130, in that a framework 122 of the workpiece guide 121 is displaced around a pivot point 134 using a pivot guide 151, a plurality of pivot points 134 of this type being able to be combined into a rotational axis 134.

The workpiece guide 121 is driven in this exemplary embodiment using a single hydraulic cylinder 136, which is provided on the bottom of the framework 122. Using a suitable activation of the hydraulic cylinder 136, the workpiece guide 121 can be pivoted around the rotational axis 134 and thus displaced perpendicularly 139 to the drawing axis 131. The workpiece 107 to be drawn can thus be adjusted nearly arbitrarily relative to the drawing ring 108, whereby influence can advantageously be taken rapidly and with a simple construction on the mass distribution inside the workpiece 107. Required data for the correct and exact activation may be obtained using the previously described measuring unit 119, in that the measuring unit 119 ideally ascertains the mass distribution of the workpiece material 120 in real time and outputs corresponding control commands as needed to the single hydraulic cylinder 136.

For outstandingly reliable supply of the workpiece 107, the displaceable workpiece guide 121 also has a first roll pair 123 and a second roll pair 124 having correspondingly shaped four rolls 125 here, on the one hand, whereby the workpiece 107 experiences good lateral guiding. On the other hand, two roller pairs 126 and 127 having a total of four rollers 128 are used for guiding the workpiece 107 in the vertical direction. Overall, a comfortable guide section 132 having guide points 133 (only shown here as an example in regard to one of the rolls 125, see FIG. 7) on the rolls 125 and the rollers 128 results therefrom, the guide section 132 being multiple times longer than the diameter of the workpiece 107.

LIST OF REFERENCE NUMERALS

1 linear drawing machine
2 drawing unit
3 first drawing chain
4 second drawing chain
5 drawing tool
6 rack
7 workpiece
8 drawing ring
9 drawing ring mount
10 mount carrier
11 drawing mandrel
12 conical mandrel part
13 calibrating mandrel part
14 mandrel intake
15 first transition phase
16 further transition phase
17 drawing mandrel outlet
18 ultrasonic sensor
19 measuring unit
20 workpiece material
21 workpiece guide
22 framework
23 first roll pair
24 second roll pair
25 rolls
26 first roller pair
27 second roller pair
28 rollers
29 roller guide
30 drawing direction
31 drawing axis
32 guide section
33 guide points
34 pivot point
35 upper hydraulic cylinder
36 lower hydraulic cylinder
37 first lateral hydraulic cylinder
38 second lateral hydraulic cylinder
39 perpendicular
40 floor
107 workpiece
108 drawing ring
109 drawing ring mount
110 mount carrier
111 drawing mandrel
119 measuring unit
120 workpiece material
121 workpiece guide
122 framework
123 first roll pair
124 second roll pair
125 rolls
126 first roller pair
127 second roller pair
128 rollers
130 drawing direction
131 drawing axis
132 guide section
133 guide points
134 pivot point and/or pivot axis
136 hydraulic cylinder
139 perpendicular
150 drawing head
151 pivot guide

The invention claimed is:

1. A method for the linear drawing of a workpiece (7; 107) through a drawing ring (8; 108), a drawing unit (2) being situated behind the drawing ring (8; 108), which grasps the workpiece (7; 107) using a drawing tool (5) or using multiple drawing tools (5) and draws it linearly in a drawing direction (30; 130), wherein the drawing ring (8; 108) is oriented perpendicular to the drawing direction (30; 130) during the drawing procedure and the workpiece (7; 107) is inserted into the drawing ring (8; 108) using a workpiece guide (21; 121) which is situated in front of the drawing ring (8; 108) in the drawing direction (30; 130) and is displaceable perpendicular (39) to the drawing direction (30; 130), said workpiece guide (21; 121) being able to cause an eccentric feed of said workpiece to the drawing ring.

2. The method for linear drawing of a tubular workpiece (7; 107) according to claim 1 using a drawing mandrel (11; 111) provided at the height of the drawing ring (8; 108), wherein the drawing mandrel (11; 111) is mounted freely perpendicular (39) to the drawing direction (30; 130), and wherein the drawing mandrel (11; 111) is mounted opposite to the drawing direction (30; 130).

3. The linear drawing method according to claim 1, wherein a mass distribution is measured in the cross-section of the workpiece (7; 107) and the workpiece guide (21; 121) is displaced according to the measured mass distribution.

4. The linear drawing method according to claim 1, wherein the workpiece guide (21; 121) is displaced around a pivot point (34; 134).

5. The linear drawing method according to claim 4, wherein the pivot point (34; 134) is situated on a drawing axis (31; 131).

6. The linear drawing method according to claim 5, wherein the pivot point (34; 134) is situated on the drawing axis (31; 131) at the height of the drawing ring (8; 108).

* * * * *